United States Patent [19]

Santavaci

[11] Patent Number: 4,858,922

[45] Date of Patent: Aug. 22, 1989

[54] METHOD AND APPARATUS FOR DETERMINING THE VELOCITY AND PATH OF TRAVEL OF A BALL

[75] Inventor: Jerome Santavaci, Reno, Nev.

[73] Assignee: Intermark Amusements, Inc., Scottsdale, Ariz.

[21] Appl. No.: 217,956

[22] Filed: Jul. 12, 1988

[51] Int. Cl.[4] ..... A63B 69/00

[52] U.S. Cl. ..... 273/26 R; 273/29 A; 273/184 R; 273/185 R; 273/186 R

[58] Field of Search ..... 273/26 R, 29 A, 183 R, 273/183 A, 184 R, 185 R, 185 A, 185 B, 186 R, 186 A; 342/103, 115

[56] References Cited

U.S. PATENT DOCUMENTS

| | | | |
|---|---|---|---|
| 3,194,562 | 7/1965 | Speiser | 273/181 |
| 3,438,031 | 4/1969 | Fathauer | 342/103 |
| 3,508,440 | 4/1970 | Murphy | 273/184 R |
| 3,655,202 | 4/1972 | Gautraud et al. | 273/183 R |
| 3,759,528 | 9/1973 | Christophers et al. | 273/185 R |
| 3,938,809 | 2/1976 | Gentiluomo | 273/184 R |
| 4,160,942 | 7/1979 | Lynch et al. | 273/183 R |
| 4,276,548 | 6/1981 | Lutz | 342/103 |
| 4,542,906 | 9/1985 | Takase et al. | 273/185 R |

*Primary Examiner*—Leo P. Picard

*Attorney, Agent, or Firm*—Cahill, Sutton & Thomas

[57] ABSTRACT

A pair of velocity sensing devices are disposed on opposite sides of the proposed path of travel of a ball with the electromagnetic energy beams from the devices directed at acute angles to the proposed path of travel. Velocity signals generated by the two devices are averaged and converted to visible messages concerning the speed of the ball and its likely distance of travel had its flight not been interrupted. Velocity signals are also compared to generate a visible message concerning the deviation of the actual path of travel of the ball from the proposed path of travel.

8 Claims, 2 Drawing Sheets

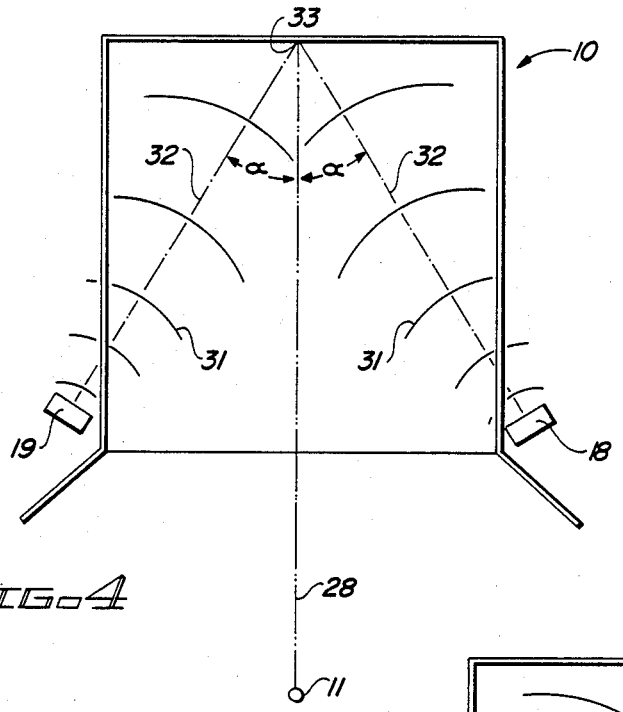
FIG. 4
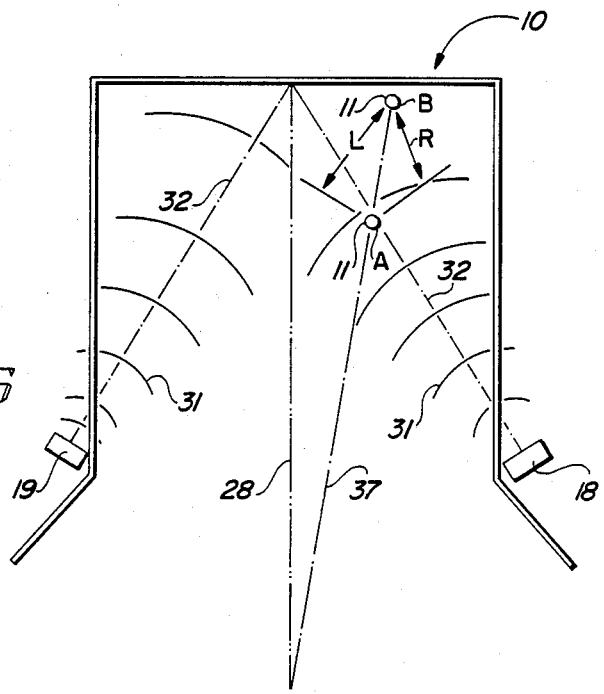
FIG. 5
FIG. 6
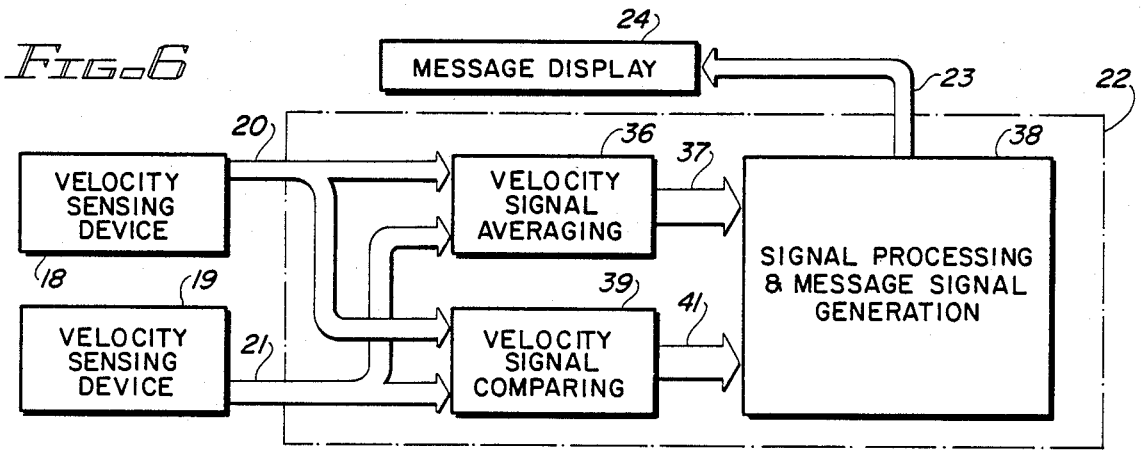

METHOD AND APPARATUS FOR DETERMINING THE VELOCITY AND PATH OF TRAVEL OF A BALL

TECHNICAL FIELD

This invention is concerned with improving the skills of a person in striking a ball, such as a golf ball or a baseball. It provides a method and apparatus for measuring the velocity and path of movement, or trajectory, of a struck ball and for delivering messages to the user concerning the velocity of the ball, its likely distance of travel and its deviation from an ideal path. This is accomplished with apparatus which occupies only a small portion of the space normally allotted for a practice area, such as a golf driving range or a baseball field. Because the flight of the ball is stopped after a very short trajectory the ball can be readily retrieved for another practice swing.

BACKGROUND ART

It is common practice to measure the speed of a pitched baseball with a, so called, radar gun. And a variety of devices have been produced which utilize doppler radar to track and determine the speed and direction of movement of various moving objects.

So far as is known, however, none of these devices has been integrated into a system for determining the speed and trajectory of a struck ball within a small space.

DISCLOSURE OF THE INVENTION

This invention utilizes a pair of electromagnetic velocity sensing devices positioned on opposite sides of the proposed, or ideal, path of movement of the ball. The electromagnetic fields emitted by the sensing devices are directed across the proposed path of ball travel at acute angles thereto. For ball speed and distance determination velocity signals generated by the sensing devices are averaged. Messages are generated and displayed to the user in order that he may learn what velocity he imparted to the ball and how far it likely would have gone had it not been stopped by a cage provided for this purpose. The velocity signals from the two sensing devices are also compared and a signal generated which represents the difference between the velocities sensed by the two devices. A message is generated corresponding to the differential signal to advise the user the extent to which the ball has been driven to the right or to the left of the proposed, or ideal, path of movement.

BRIEF DESCRIPTION OF THE DRAWINGS

The invention is described in greater detail hereinafter by reference to the accompanying drawings wherein:

FIG. 4 is a schematic plan view of the cage;

FIG. 5 is a view similar to FIG. 4 illustrating the method of determining deviation of the actual path of travel of the ball from the proposed, or ideal, path of travel; and FIG. 6 is a block diagram illustrating the manner in which information is processed in the invention.

BEST MODE FOR CARRYING OUT THE INVENTION

The purpose of this invention is instruction of a person as to the speed and accuracy with which he or she has struck a ball and to do so with apparatus which occupies only a fraction of the space normally associated with practice of that activity. The invention is particularly suited for instructing a golfer as to the speed, distance and accuracy with which he has propelled a golf ball from a practice tee and the invention is described in detail hereinafter by particular reference to determining the velocity, range and path of movement of a golf ball. But the invention is equally applicable for measurement of the flight of a baseball which has been struck by a bat and the flight of a football which has been kicked.

Regardless of the type of ball involved, the apparatus and method of this invention enable the desired measurements of ball movement to be made and information provided to the user in an area of no more than a few square feet (approximately 8′×14′) and a height of space little greater than the height of the user. Thus, the advantages of the invention can be enjoyed without the luxury of employing a golf course fairway, a driving range, a baseball playing field or a football field. The apparatus and method can even be used indoors either as a serious practice and training facility or merely as an entertainment and amusement device.

Figure 1:
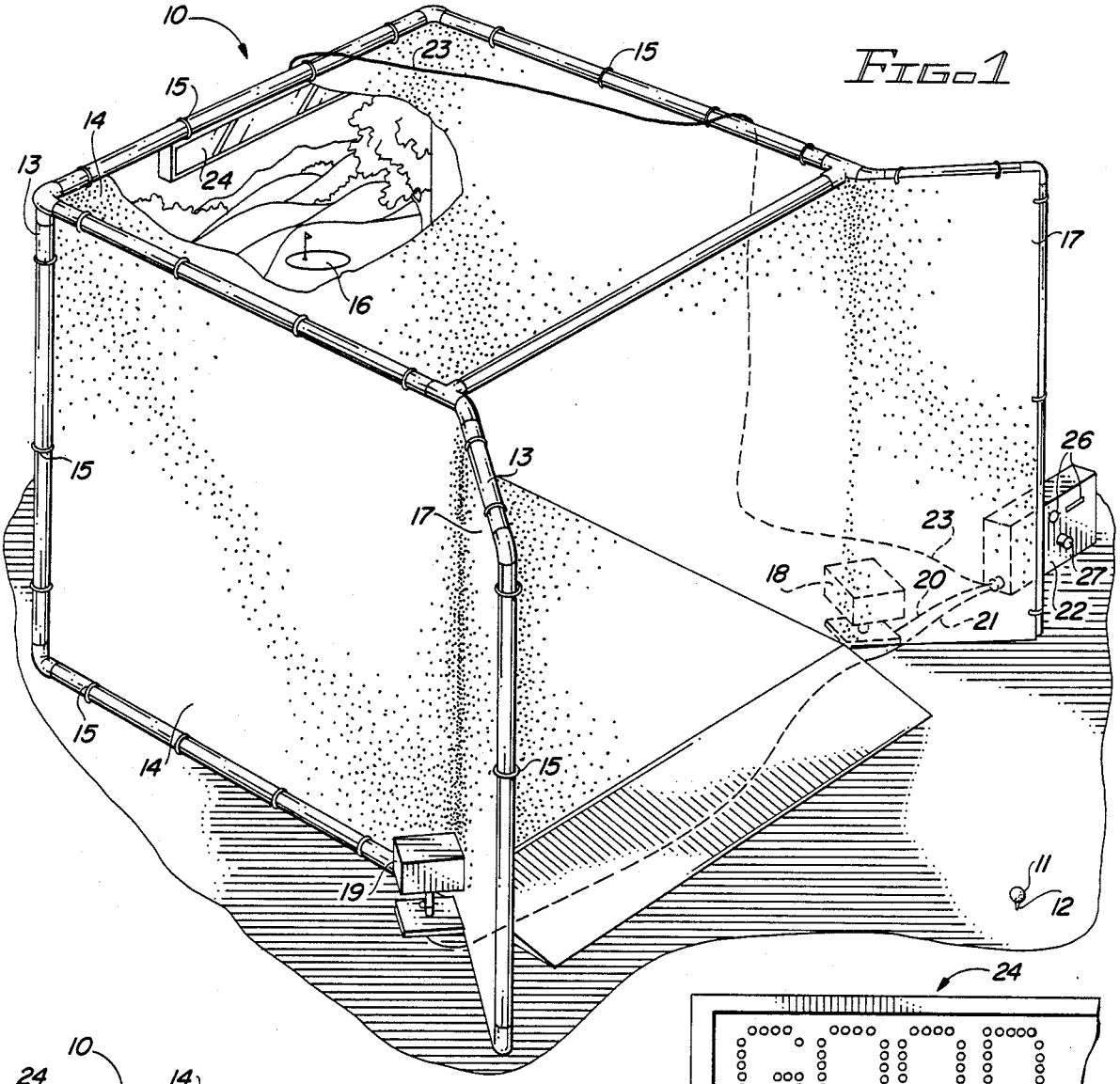
FIG. 1 is a perspective view of a golf ball driving cage embodying this invention.

Referring particularly to FIG. 1, there is there illustrated a golf ball driving cage, indicated generally by reference numeral 10, adapted to have a ball 11 driven into its interior from a tee 12. The cage 10 can be constructed of any material which is not subject to being damaged when struck by the ball 11 which travels at a substantial velocity. Typically, a golf ball entering cage 10 will be traveling at a velocity of as little as 35 mph or as high as 400 mph, with a reasonably proficient golfer driving his ball in excess of 150 mph.

In its preferred form cage 10 is comprised of a lightweight, plastic or metal, tubular frame 13 which supports a fabric liner 14. Fabric liner 14 is suspended inside the frame 13 by means of cord loops 15 which allow the liner to be spaced inwardly from the frame 13 so that balls striking the liner do not impact and damage the frame. Typically, a golf ball driving cage 10 will have dimensions of approximately 5′ wide × 5′ deep × 6′ tall.

If desired, the wall 16 of liner 14 at the rear of the cage 10 may have a representation of a fairway or a driving range reproduced therein to impart a degree of realism to use of the cage. The liner 14 and frame 13 may also be constructed to provide side guards 17 for directing errant balls into the cage 10.

Figure 2:
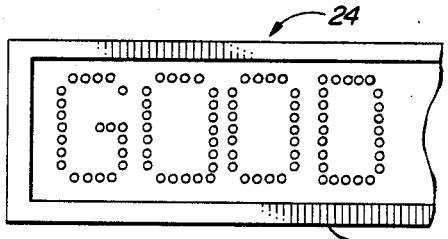
FIG. 2 is a fragmentary illustration of a message display unit employed in the invention.

The apparatus of this invention includes means for measuring the velocity and path of movement of ball 11 into cage 10 and for generating messages based on that information to advise the user of the velocity of the ball he has just hit, how far the ball likely would have gone had it not been stopped by the cage, and an indication of the degree of departure of the actual trajectory of the ball to the right or the left of an ideal path down the middle of the fairway. This apparatus is illustrated in FIG. 1 and includes a pair of velocity sensing devices 18 and 19 positioned on opposite sides of the cage 10 near the entrance thereto. Sensing devices 18 and 19 are connected by signal leads 20 and 21, respectively, to a control unit 22. Control unit 22 is, in turn, connected via a signal lead 23 to a message display unit 24 which is shown in greater detail in FIG. 2.

Control unit 22 houses the apparatus for processing the velocity signals from sensing devices 18 and 19 and for practicing the method of this invention for producing message signals to generate the display of messages by display unit 24. For some applications the control unit 22 will include means, indicated at 26, for accepting coin or paper currency as payment for use of the apparatus. This unit also contains some means, such as a button 27, for initiating operation of the apparatus.

The velocity sensing devices 18 and 19 are identical and each preferably is of the type which transmits a directional electromagnetic energy field therefrom and senses electromagnetic energy reflected from a ball traveling through its field. By measuring the doppler shift in wave energy reflected to the sensing device the device indirectly measures the velocity of the ball.

A motion detector sold by Protection Technologies Inc., Reno, Nevada, under the trademark "HI-TECH 100" has the basic components required for velocity sensing devices 18 and 19. The Protection Technologies unit has a microwave sensor operating in the region of 10 gigahertz with a wave length of 3 cm. This sensor can detect a doppler shift from a ball travel of 3 cm. and is therefore able to measure the time it takes for the ball to travel that distance. The travel time is, of course, inversely proportional to the velocity of the ball. The sensor, thus, can generate a velocity signal which can be further processed in accordance with this invention to provide the desired messages for the user. The Production Technologies unit is capable of making a series of time/velocity measurements during the short path of travel of the ball within cage 10 and these measurements can be averaged to produce a particularly accurate velocity signal from each velocity sensing device 18 and 19.

Figure 3:
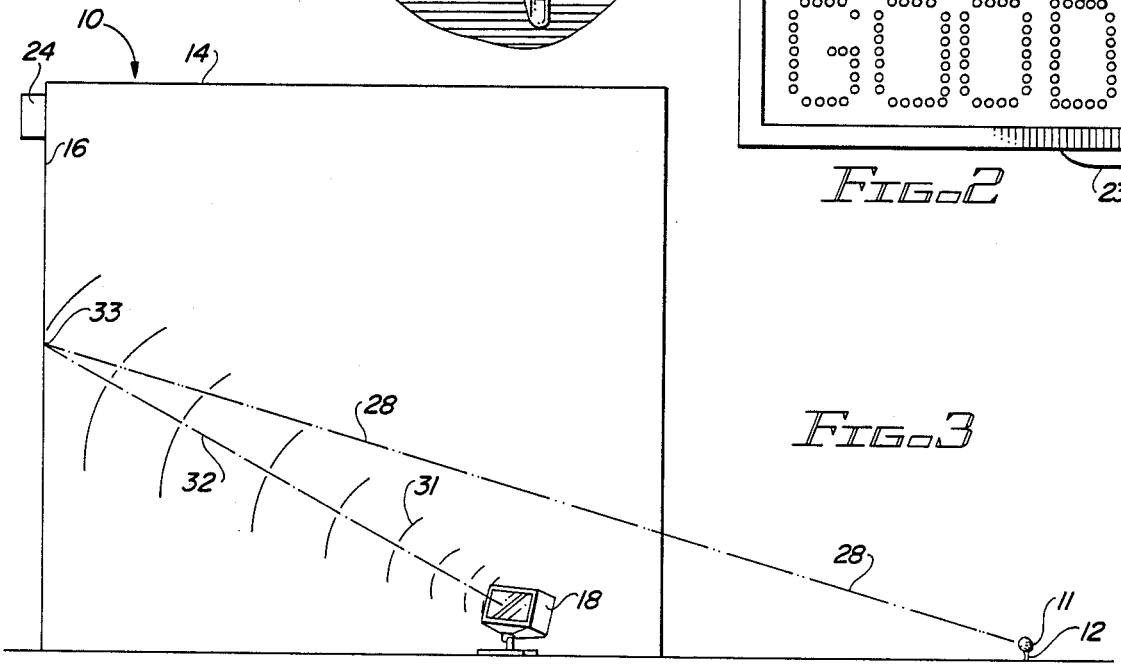
FIG. 3 is a vertical sectional view through the cage of FIG. 1.

Placement of velocity sensing devices 18 and 19 in relation to the proposed, or ideal, path of travel, or trajectory, of the ball 11 is important for proper utilization of the velocity signals therefrom. That placement is illustrated in FIGS. 3 and 4 of the drawing. In these figures dot-dash line 28 represents the proposed, or ideal, path of travel of the ball 11. Velocity sensing devices 18 and 19 are mounted on the ground, or other surface on which the apparatus is mounted, with the devices on opposite sides of and equidistant from the proposed path of ball travel 28. When viewed from the position of the golfer addressing ball 11 on tee 12 device 18 is to the right and device 19 is to the left.

Each velocity sensing device 18 and 19 has a directional electromagnetic field 31 transmitted from the face thereof across the proposed path of travel 28 of the ball 11. The center line of the electromagnetic field from each of the devices 18 and 19 is depicted in FIGS. 3 and 4 by a dot and dash line 32. The field emitting faces of devices 18 and 19 are preferably tilted upwardly slightly (see FIG. 3) so that the center lines 32 of their electromagnetic fields are directed toward and pass through that spot 33 on rear wall 16 of cage 10 through which the proposed path of travel 28 of the ball 11 passes. In addition, as shown in FIG. 4, the placement of velocity sensing devices 18 and 19 horizontally is such that the center lines 32 of their electromagnetic fields 31 cross the proposed path of travel 28 at acute angles $\alpha$ with respect thereto. Angles $\alpha$ for both velocity sensing devices 18 and 19 are equal and are preferably of the order of 30°.

Each velocity sensing device 18 and 19 is capable of generating a velocity signal representing the velocity of travel of ball 11 through its field 31 in the direction of its field. In other words, each device 18 and 19 senses the velocity of the ball based on movement of the ball relative each device. Now, if the flight of the ball is exactly along the proposed, or ideal, path 28 in relation to which the devices 18 and 19 are positioned equidistant, then both devices will see, or sense, the same velocity of the ball. This is the condition shown in FIG. 4.

However, if the actual path of travel, or trajectory, of the ball 11 is off to either side of the ideal path 28 the velocity sensing devices 18 and 19 will sense and measure different apparent velocities. This phenomenon is illustrated in FIG. 5 in which the off center flight path of ball 11 is depicted by dot and dash line 37. This path of movement 37 is to the right of ideal path 28. As the ball progresses along flight path 37 from point A to point B velocity sensing device 18 will perceive the flight distance of the ball relative to itself as indicated as R in FIG. 5. At the same time velocity sensing device 19 will perceive that the ball has progressed a greater distance L. Now if devices 18 and 19 are measuring the period of time it takes ball 11 to traverse a predetermined distance, device 19 will perceive that it takes less time for the ball to travel that distance while device 18 will perceive that it takes more time for the ball to travel that same distance. Viewed from this perspective, sensing device 19 perceives a greater velocity for ball 11 than is perceived by sensing device 18. The difference between these two velocities is indicative of the amount of deviation between the ideal path 28 for the ball and the actual path 37 for the ball. Moreover, the velocity signals generated by velocity sensing devices 18 and 19 are capable of indicating whether the off center flight path 37 of the ball is to the right or to the left of the ideal path 28. When the velocity signal generated by device 19 is greater than that generated by device 18 the ball flight path is to the right of the ideal path 28 and when the velocity signal generated by device 18 is greater than that generated by device 19 the flight path of the ball is to the left of the ideal path 28.

The method by which the various velocity signals from sensing devices 18 and 19 are utilized to generate informational messages for the user of the apparatus is schematically illustrated by block diagram in FIG. 6.

First, let us consider the function of informing the user with respect to the ball velocity and distance he has achieved with the swing of his club. Velocity signals from velocity sensing devices 18 and 19 are fed over signal leads 20 and 21 to a velocity signal averaging computer 36 contained with control unit 22. If the velocity signals from devices 18 and 19 are equal, reflecting a down the middle, or ideal, flight path 28 of the ball 11, the average of the two signals is the same as the signals themselves and this signal is sent via lead 37 to a signal processor and message signal generator 38 also contained within control unit 22. On the other hand, if the velocity signals from devices 18 and 19 differ, the flight path 37 of ball 11 is off the ideal path and its velocity in relation to the desired path should be discounted. This is done by the velocity averaging computer to produce an average velocity signal over lead 37 to signal processing unit 38. The function of the signal processor message signal generator 38 is to convert the average velocity signal from computer 36 to a message signal to be transmitted to message display 24 via lead 23 to cause the message display to present intelligible, useful information to the user of the apparatus. Message display 34 may take the form of a moving message sign such as that produced by Text-Lite Inc. of Newport Beach, Calif., with a model designation of "TL1-C". A typical message concerning velocity of the ball might read, for example, "GREAT HIT . . .257 mph" or "A LITTLE LIGHT . . . 97 mph".

The same average velocity signal produced by computer 36 is also utilized by signal processor and message signal generator 38 to generate a message signal corresponding to the distance the ball 11 likely would have traveled when it possesses the sensed average velocity at the initial portion of its trajectory. This distance signal can easily be calculated from the velocity of the ball verses the earth's gravitational acceleration rate of 32 ft./sec./sec., and assuming an arbitrary angle of entry past the velocity sensing devices 18 and 19. With but two sensing devices on opposite sides of the flight path of the ball 11 it is not possible to measure or compute the actual angle of entry of the ball. However this is of no particular significance inasmuch as velocity is by far the most significant determinate of distance of flight. It can be shown that variations in angle of entry of a golf ball flight path of as much as 15° results in distance differences of only plus or minus five yards for equal velocities.

The distance signal transmitted from generator 38 to message display 34 causes the display to exhibit messages such as, for example, "INCREDIBLE SHOT . . . 357 yards" or "PUT MORE SHOULDER INTO IT . . . ONLY 75 YARDS".

Of course, because an average velocity signal from the two velocity sensing devices 18 and 19 is used to generate the distance messages those messages are discounted in value for ball flight paths that are off course from the ideal path 28.

Lastly, information concerning the degree of departure of the actual ball flight path 37 from ideal flight path 28 (see FIG. 5) is imparted to the user via the message display 24. The message signal for this purpose is generated as follows. Velocity signals from velocity sensing devices 18 and 19 are fed to a velocity signal comparator computer 39 also located in control unit 22. Computer 39, as its name implies, compares the velocity signal from device 18 to the velocity signal from device 19, ascertains the difference between the two, and generates a differential signal representing the degree by which the actual flight path departs from the ideal flight path and the direction of the departure, i.e., to the left or to the right. This differential signal is transmitted over lead 41 to the signal processing and message signal generator 38. The latter unit generates message signals to cause the message display 24 to present appropriate flight path information to the user. Such messages might read, for example, "A LITTLE TO THE LEFT OF THE FAIRWAY" or "IN THE ROUGH ON THE RIGHT".

From the foregoing it should be apparent that this invention provides a wealth of useful information as to the accuracy with which a person has struck a ball. Because the ball used is authentic, not some lightweight practice ball, the user has the feel of actual play, better enabling him to improve his game.

The small space required for the apparatus of this invention enables the invention to be practiced in almost any place desired. Because the ball is required to travel only a short distance retrieval of the ball is quick and easy.

What is claimed is:

1. Ball velocity measuring apparatus comprising first and second velocity sensing devices, each of said sensing devices being adapted for transmitting a directional electromagnetic field therefrom and for sensing electromagnetic energy reflected from a ball traveling through its field, said devices being positioned on opposite sides of the proposed path of movement of the ball with their transmitted electromagnetic fields directed across the proposed path of the ball at acute angles thereto, each of said sensing devices generating signals reflecting the velocity at which the ball appears to be moving in the direction of its respective electromagnetic field, means for averaging the velocity signals generated by the sensing devices and for generating an average velocity signal, means for generating a velocity message corresponding to said average velocity signal, and means for displaying said message.

2. Ball trajectory measuring apparatus comprising first and second velocity sensing devices, each of said sensing devices being adapted for transmitting a directional electromagnetic field therefrom and for sensing electromagnetic energy reflected from a ball traveling through its field, said devices being positioned on opposite sides of and equidistant from an ideal trajectory for the ball with their transmitted electromagnetic fields directed across the ideal trajectory at equal acute angles thereto each of said sensing devices generating velocity signals reflecting the velocity at which the ball appears to be moving within and in the direction of its respective electromagnetic field, means for comparing the velocity signals generated by said sensing devices and for generating a differential signal in response to the difference between said velocity signals, means for generating a message indicating the degree of departure of the ball trajectory from said ideal trajectory represented by said differential signal, and means for displaying said message.

3. The measuring apparatus of claim 2 further comprising means for averaging the velocity signals generated by said sensing devices and for producing an average velocity signal, and means for generating a message corresponding to said average velocity signal.

4. The measuring apparatus of claim 2 further comprising means for averaging the velocity signals generated by said sensing devices and for producing an average velocity signal, means for computing the distance of travel of the ball over a predetermined trajectory when propelled at an initial velocity corresponding to said average velocity signal and for producing a distance of travel signal, and means for generating a message corresponding to said distance of travel signal.

5. A method of measuring the velocity of the ball, comprising positioning velocity sensing devices on opposite sides of and equidistant from the proposed path of movement of the ball, each of said sensing devices being adapted for transmitting a directional electromagnetic field therefrom and for sensing electromagnetic energy reflected from a ball traveling through its field, positioning the velocity sensing devices so that their transmitted electromagnetic fields are directed across the proposed path of the ball at acute angles thereto, causing each of said velocity sensing devices to generate a velocity signal reflecting the velocity at which the ball appears to be moving in the direction of its respective electromagnetic field, averaging the velocity signals generated by said velocity sensing devices and generating an average velocity signal, converting said average velocity signal to a visual message and displaying said message.

6. A method of measuring the trajectory of a ball, comprising positioning velocity sensing devices on opposite sides of and equidistant from an ideal trajectory of the ball, each of said sensing devices being adapted for transmitting a directional electromagnetic field therefrom and for sensing electromagnetic energy reflected from a ball traveling through its field, positioning the velocity sensing devices so that their transmitted electromagnetic fields are directed across the ideal trajectory of the ball at acute angles thereto, causing each of said velocity sensing devices to generate a velocity signal reflecting the velocity at which the ball appears to be moving in the direction of its respective electromagnetic field, comparing the velocity signals generated by said sensing devices and generating a differential signal reflecting the difference between said velocity signals, generating a message indicating the degree of departure of the ball trajectory from said ideal trajectory represented by said differential signal, and displaying said degree of departure message.

7. The method set forth in claim 6 further comprising the steps of averaging the velocity signals generated by said sensing devices and producing an average velocity signal, generating an average velocity message corresponding to said average velocity signal and displaying said average velocity message.

8. The method set forth in claim 7 further comprising the steps of computing the distance of travel of the ball over a predetermined trajectory when propelled at an initial velocity corresponding to said average velocity signal, generating a distance of travel signal, generating a distance of travel message corresponding to said distance of travel signal, and displaying said distance of travel message.

* * * * *